US008636896B2

(12) United States Patent
Gueret et al.

(10) Patent No.: US 8,636,896 B2
(45) Date of Patent: Jan. 28, 2014

(54) METHOD FOR THE VALORIZATION OF HEAVY CHARGES BY BUBBLING-BED DEASPHALTING AND HYDROCRACKING

(75) Inventors: Christophe Gueret, St Romain en Gal (FR); Stéphane Kressmann, Serezin du Rhone (FR); Jan Verstraete, Lyons (FR)

(73) Assignee: IFP Energies nouvelles, Rueil-Malmaison Cedex (FR)

( * ) Notice: Subject to any disclaimer, the term of this patent is extended or adjusted under 35 U.S.C. 154(b) by 0 days.

(21) Appl. No.: 12/900,987

(22) Filed: Oct. 8, 2010

(65) Prior Publication Data

US 2011/0062055 A1 Mar. 17, 2011

Related U.S. Application Data

(63) Continuation of application No. 10/831,365, filed on Apr. 26, 2004, now abandoned.

(30) Foreign Application Priority Data

Apr. 25, 2003 (FR) ..... 03 05211

(51) Int. Cl.
*C10G 47/02* (2006.01)
*C10G 69/04* (2006.01)
*C10G 69/06* (2006.01)

(52) U.S. Cl.
USPC ..... 208/86; 208/58; 208/61

(58) Field of Classification Search
None
See application file for complete search history.

(56) References Cited

U.S. PATENT DOCUMENTS

| | | | | |
|---|---|---|---|---|
| 2,973,313 | A | 2/1961 | Riordan | |
| 3,245,900 | A | 4/1966 | Paterson | |
| 3,268,437 | A | 8/1966 | Beuther et al. | |
| 4,120,778 | A | 10/1978 | Goudriaan et al. | |
| 4,447,313 | A | 5/1984 | Smith et al. | |
| 4,525,267 | A | 6/1985 | Inooka | |
| 5,089,114 | A | 2/1992 | Tovar et al. | |
| 5,382,349 | A * | 1/1995 | Yoshita et al. | 208/49 |
| 6,179,995 | B1 | 1/2001 | Cash et al. | |
| 2008/0289999 | A1 * | 11/2008 | Lenglet | 208/309 |
| 2009/0288986 | A1 * | 11/2009 | Colyar et al. | 208/58 |
| 2009/0308788 | A1 * | 12/2009 | Lenglet | 208/57 |
| 2010/0282640 | A1 * | 11/2010 | Rojey et al. | 208/49 |
| 2010/0326883 | A1 * | 12/2010 | Van Wees et al. | 208/44 |
| 2011/0139681 | A1 * | 6/2011 | McGehee et al. | 208/96 |

* cited by examiner

*Primary Examiner* — Tam M Nguyen
(74) *Attorney, Agent, or Firm* — Millen, White, Zelano & Branigan, P.C.

(57) ABSTRACT

The invention relates to a method for treating a hydrocarbons charge comprising the following stages, in which:

a) the charge is brought into contact with a solvent in order to obtain a deasphalted effluent having a content of asphaltenes below 3000 ppm by weight, b) the deasphalted effluent is cracked in the presence of hydrogen and a hydrocracking catalyst, in a bubbling-bed reactor, so as to convert at least 50 wt. % of the fraction of the deasphalted effluent boiling above 500° C. to compounds having a boiling point below 500° C., c) the effluent from stage b) is fractionated to recover gasolines, kerosene, gas oils and a first residue, and d) at least a portion of this first residue is cracked so as to obtain an effluent comprising gasolines, kerosene, gas oils and a second residue.

11 Claims, 2 Drawing Sheets

METHOD FOR THE VALORIZATION OF HEAVY CHARGES BY BUBBLING-BED DEASPHALTING AND HYDROCRACKING

This application is a continuation of U.S. patent application Ser. No. 10/831,365, filed Apr. 26, 2004, now abandoned, which is incorporated by reference herein.

The field of the present invention is the refining of petroleum fractions. It relates in particular to the field of processes for treatment of heavy charges such as residues from atmospheric distillation or from vacuum distillation.

In view of the increasing demand for fuels, gasolines and diesel fuel, and the decline in consumption of heavy fuel oils, it is becoming more and more important to be able to convert the bottom of the barrel to a very high level.

This is particularly true for certain countries where the local oil output consists essentially of so-called heavy crudes for example Athabasca crude in Canada, Morichal in Venezuela, containing very few, light distillates. In fact, these heavy crudes contain about 80 wt. % of vacuum residue. These crudes are also characterized by a low API density, below 12.

Moreover, the heavy charges such as atmospheric residues and vacuum residues contain large amounts of metals, sediments and asphaltenes. When these charges are used in thermal conversion processes, such as a visbreaking, the impurities in these charges quickly lead to coking and the clogging of capacities by flocculation and sedimentation. When these same charges are used in fixed-bed catalytic conversion processes, the presence of impurities' makes it necessary to use a guard bed to protect the refining catalysts and avoid too rapid a deactivation, thus increasing the volume of the reactors in these units.

Furthermore, in fixed-bed conversion units, the conversion of the charge is limited by thermal levels that are lower than in bubbling-bed conversion units. When these charges are used as they are in bubbling-bed catalytic conversion processes, the presence of these impurities leads to an increase in the rate of catalyst replacement.

French patent FR 2 803 596 describes a method for the conversion of distillates comprising a bubbling-bed hydroconversion stage, a separation stage in which a light fraction and a heavy fraction are obtained, and a stage of catalytic cracking of the heavy fraction. Such a process can lead to high conversion rates, but its employment is generally envisaged only for charges having a final boiling point below 600° C. Moreover, the Method described in this patent is not suitable, a priori, for the treatment of an atmospheric residue or of a vacuum residue originating from a heavy crude.

A method has been found that makes it possible to overcome the aforementioned drawbacks and also obtain high yields of gasolines, kerosene and gas oils, starting from residues originating from an atmospheric distillation or from a vacuum distillation of a heavy crude. This method also makes it possible to obtain products of good quality that do not require post-treatment or require only moderate post-treatments.

The present invention therefore relates to a method of treatment of a hydrocarbon charge of which at least 95 wt. % consists of compounds having a boiling point of at least 340° C., characterized in that it comprises the following stages, in which:

a) the charge is brought into contact with a solvent in order to obtain a deasphalted effluent having a content of asphaltenes (insoluble in n-heptane according to standard NF-T-60-115) below 3000 ppm by weight, b) the deasphalted effluent is cracked in the presence of hydrogen and a hydrocracking catalyst, in a bubbling-bed reactor, so as to convert at least 50 wt. % of the fraction of the deasphalted effluent boiling above 500° C. to compounds having a boiling point below 500° C., c) the effluent from stage b) is fractionated to recover gasolines, kerosene, gas oils and a first residue, and d) at least a portion of this first residue is cracked catalytically so as to obtain an effluent comprising gasolines, kerosene, gas oils and a second residue.

An advantage of the invention is that it provides a method that makes it possible to obtain a better valorization of heavy charges such as atmospheric residues, vacuum residues obtained from any crude oils, in particular from heavy crudes. These heavy crudes generally have an API density below 12.

Another advantage of the invention is that it provides a method that makes it possible to aim at a high overall yield of gasolines, kerosene and gas oils.

Another advantage of the invention is that it provides a method that makes it possible to obtain gasolines, kerosene and gas oils having excellent qualities and to limit the number or the severity of post-treatments.

For better understanding, two non-limiting embodiments of the method of the invention are illustrated by drawings.

Figure 1:
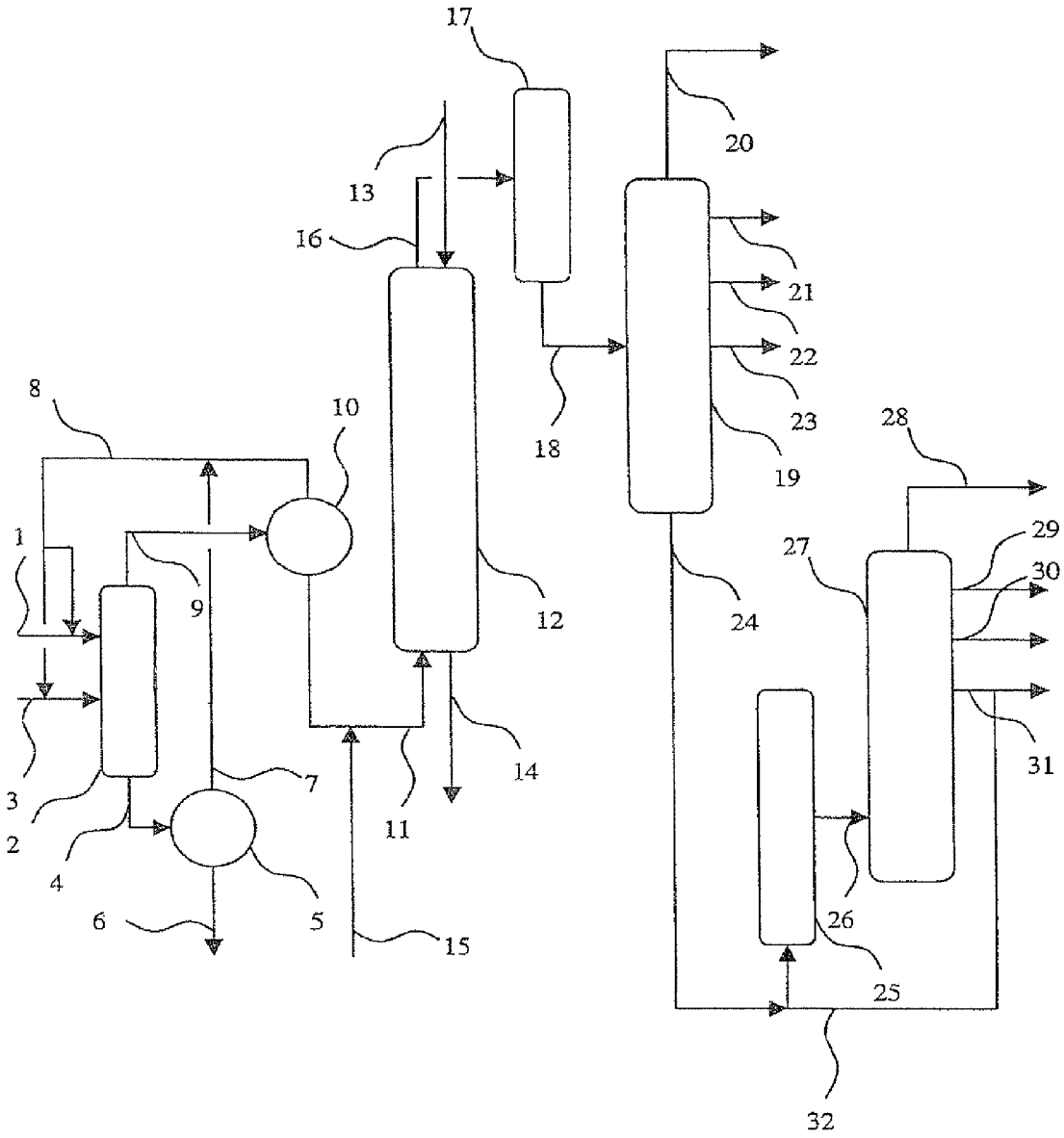
FIG. 1 shows, as an example, an embodiment of the method according to the invention comprising the following in succession: a deasphalting stage, a bubbling-bed hydroconversion stage, a stage of fractionation by atmospheric distillation and a stage of catalytic cracking of the FCC type.

The charges that can be treated by the method of the invention are hydrocarbons of which at least 95 wt. % consists of compounds having a boiling point of at least 340° C. and which can reach 700° C. or more, for example between 500° C. and 700° C.

The hydrocarbon charge has a final boiling point, preferably above 600° C., more preferably above 650° C., and even more preferably above 700° C.

These charges can be atmospheric residues and vacuum residues. For example, these charges can be residues from direct distillations or from conversion processes such as coking, fixed-bed hydroconversion processes such as the HYVAHL process or bubbling-bed processes such as the H-Oil process. The charges can be formed by mixing these fractions in any proportion or by dilution in petroleum fractions with a boiling point below 360° C.

The invention proves particularly beneficial for certain residues of heavy crudes, i.e. crudes containing few distillates. Typically Athabasca and Morichal crudes contain 80% of vacuum residues. Their API density is generally close to 10. These heavy crudes contain, compared with other crudes, many more impurities such as, for example, metals (nickel, vanadium, silicon, etc.), a high Conradson carbon residue, asphaltenes, sulphur and nitrogen.

Thus, according to a preferred embodiment, the hydrocarbon charge consists essentially of atmospheric residues, of which at least 95 wt. % consists of compounds having a boiling point of at least 600° C., and vacuum residues from heavy crudes, of which at least 95 wt. % consists of compounds having a boiling point of at least 650° C.

During stage a) of the method of the invention, the charge is brought into contact with a solvent in order to obtain a deasphalted effluent. This operation is often described as solvent deasphalting. It makes it possible to extract a high proportion of the asphaltenes and to reduce the metals content. During this deasphalting, the latter elements become concentrated in an effluent called asphalt. The deasphalted effluent, often called deasphalted oil, has a reduced content of asphaltenes and metals.

One of the aims of the deasphalting stage is, on the one hand, to maximize the amount of deasphalted oil and, on the other hand, to maintain, or even minimize, the content of asphaltenes. The said content of asphaltenes is generally determined in terms of content of asphaltenes insoluble in heptane, i.e. measured in accordance with a method described in standard NF-T-60-115 of January 2002.

According to the invention, the asphaltenes content of the deasphalted effluent is less than 3000 ppm by weight.

Preferably, the asphaltenes content of the deasphalted effluent is less than 1000 ppm by weight, and more preferably less than 500 ppm by weight.

Below an asphaltenes content of 500 ppm by weight, the method of standard NF-T 60-115 is no longer adequate for measuring the said content. The applicant has developed an analytical method, covering the quantitative analysis of asphaltenes in products of direct distillation and in heavy products obtained from deasphalting of residues. This method can be used for asphaltene concentrations below 3000 ppm by weight and above 20 ppm by weight. The method in question consists of comparing the absorbance at 750 nm of a sample in solution in toluene with that of a sample in solution in heptane after filtration. The difference between the two measured values is correlated to the concentration of heptane-insoluble asphaltenes using a calibration equation. This method supplements AFNOR method T60-115 and the standard method IP143 which are used for higher concentrations.

The solvent used in the deasphalting stage a) is advantageously a paraffinic solvent, a gasoline fraction or condensates containing paraffins.

Preferably, the solvent used in stage a) contains at least 50 wt. % of hydrocarbon compounds having between 3 and 7 carbon atoms, more preferably between 5 and 7 carbon atoms, even more preferably 5 carbon atoms.

The yield of deasphalted oil and the quality of the said oil can vary, depending on the solvent used. For example, on changing from a solvent with 3-carbon atoms to a solvent with 7 carbon atoms, the yield of oil increases, but against this there is also an increase in the levels of impurities (asphaltenes, metals, Conradson carbon residue, sulphur, nitrogen, etc.).

The following table shows, by way of example, the effect of the number of carbon atoms in the hydrocarbon compounds of the solvent on the yields of deasphalted oil and on the quality of the oil during the deasphalting of a vacuum residue (VR) Arab Light.

| | Solvent | | |
|---|---|---|---|
| | C3 | C4 | C5 |
| Yield of deasphalted oil relative to vacuum residue, wt. % | base | base + 30 | base + 45 |
| Characteristics of the oil | | | |
| Density d15/4 | 0.933 | 0.959 | 0.974 |
| Sulphur (wt. %) | 2.6 | 3.3 | 3.7 |
| Conradson carbon residue (wt. %) | 1.9 | 5.9 | 7.9 |
| C7 Asphaltenes (wt. %) | <0.05 | 0.07 | 0.15 |
| Ni (ppm) | 1 | 3 | 7 |
| V (ppm) | 1.5 | 2.5 | 15.5 |

Moreover for a given solvent, the choice of operating conditions especially the temperature and the amount of solvent injected, has an effect on the yield of deasphalted oil and on the quality of the said oil. A person skilled in the art is able to select the optimum conditions to obtain a content of asphaltenes below 3000 ppm.

The deasphalting stage a) can be carried out by any means known to a person skilled in the art. Stage a) is generally carried out in a mixer-settler or in an extraction column. Preferably, the deasphalting stage is carried out in an extraction column.

In a preferred embodiment, a mixture consisting of the hydrocarbons charge and a first fraction of a solvent charge is introduced into the extraction column, the ratio by volume between the solvent charge fraction and the hydrocarbons charge being called the ratio of solvent injected with the charge. The purpose of this stage is thorough mixing of the charge with the solvent entering the extraction column. In the settling zone at the bottom of the extractor, it is possible to introduce a second fraction of the solvent feed, the ratio by volume between the second fraction of solvent charge and the hydrocarbons charge being called the ratio of solvent injected at the bottom of the extractor. The volume of the hydrocarbons charge considered in the settling zone is generally that introduced into the extraction column. The sum of the two ratios by volume between each of the fractions of the solvent charge and the hydrocarbon charge is called the overall solvent ratio. Settling of the asphalt consists of counter-current washing of the asphalt emulsion in the solvent+oil mixture with pure solvent. It is promoted by an increase in the solvent ratio (it is actually the replacement of the solvent+oil environment with an environment of pure solvent) and a lowering of the temperature.

The overall solvent ratio is preferably above 4/1, more preferably above 5/1.

This overall solvent ratio breaks down into a proportion of solvent injected with the charge, preferably between 1/1 and 1.5/5, and a proportion of solvent injected at extractor bottom, preferably above 3/1, more preferably above 4/1.

Furthermore, in a preferred embodiment, a temperature gradient is established between column top and bottom, making it possible to create an internal reflux, which makes it possible to improve the separation between the oily medium and the resins. In fact, the solvent+oil mixture heated at the top of the extractor makes it possible to precipitate a fraction containing resin that descends in the extractor. The ascending counter-current of the mixture makes it possible for the lightest resin-containing fractions to be dissolved at a lower temperature.

The temperature at the top of the extractor is preferably between 175 and 195° C. As for the temperature at extractor bottom, it is preferably between 135 and 165° C.

The pressure prevailing within the extractor is generally adjusted so that all the products remain in the liquid state. The said pressure is preferably between 4 and 5 MPa.

In stage b) of the method of the invention, the deasphalted effluent is cracked in the presence of hydrogen and a hydrocracking catalyst, in a bubbling-bed reactor according to the T-Star technology described, for example, in the article "Heavy Oil Hydroprocessing", published by the AiChe, Mar. 19-23, 1995, HOUSTON, Tex., paper number 42 d, or according to the H-Oil technology described for example in the article published by the NPRA Annual Meeting, Mar. 16-18, 1997, J. J. Colyar and L. I. Wilson, "The H-Oil Process: A Worldwide Leader in Vacuum Residue Hydroprocessing".

The benefit of carrying, out such a hydroconversion in a bubbling-bed reactor, compared with a fixed-bed reactor, is that much higher conversion rates can be achieved because of higher reaction temperatures. A maximum conversion has the advantages of reducing the unconverted residue, increasing the yields of gasolines, kerosene and gas oils, and improving the quality of the products. Thus, high conversion rates compensate, at least in part, for the losses in yield of deasphalted effluent caused by the constraints on purity of the deasphalted oil of deasphalting stage a). Thus, despite the greater quantity of asphalt produced in stage a), stages a) and b) according to the invention contribute to an increase in the yield of gasolines, kerosene and gas oils.

According to a preferred embodiment of the invention, stage b) is carried out with the addition of fresh catalyst and removal of spent catalyst. In particular, the presence of asphaltenes reduces the activity of the catalyst in the bubbling bed in terms of hydrodesulphurization, hydrodenitration, reduction of Conradson carbon residue, hydrogenation of aromatics, and demetalization, and leads to an increase in the rate of replacement of fresh catalyst.

Treating a previously deasphalted effluent, having a content of asphaltenes (insoluble in heptane) below 3000 ppm by weight, makes it possible to limit the rate of replacement of the catalyst. In fact the deasphalted effluent has a higher reactivity and a lower deactivating power, compared with the less deasphalted charges.

The conversion of the deasphalted oil to light products is defined by the following formula:

$$\frac{100*(500_{+}\text{ charge}-500_{+}\text{ product})}{500_{+}\text{ charge}}$$

in which $500_{+}$charge represents the mass fraction of the deasphalted oil consisting of components boiling above 500° C. and $500_{+}$product is the mass fraction of the product consisting of components boiling above 500° C.

According to the invention, the conditions of stage b) make it possible to achieve a conversion of at least 50 wt. %.

Preferably, the conversion of the deasphalted effluent is at least 70 wt. %, more preferably at least 75 wt. %, even more preferably at least 80 wt. %.

The operating conditions must be selected in such a way as to achieve this level of performance.

Thus, operation is at an absolute pressure that can range from 5 to 35 MPa, preferably from 6 to 25 MPa, more preferably from 8 to 20 MPa. The working temperature in stage b) can range from about 350 to about 550° C., preferably from about 380 to about 500° C. This temperature is usually adjusted according to the desired rate of hydroconversion to light products. The hourly space velocity (HSV) and the hydrogen partial pressure are important factors that are selected in relation to the characteristics of the product to be treated and the desired conversion. Most often, the HSV can be within a range from about 0.1 $h^{-1}$ to about 10 $h^{-1}$, preferably from about 0.2 $h^{-1}$ to about 5 $h^{-1}$. The quantity of hydrogen mixed with the charge can be from about 50 to about 5000 $Nm^3/m^3$, preferably from about 100 to about 1000 $Nm^3/m^3$, more preferably from about 200 to about 500 $Nm^3/m^3$, expressed in normal cubic meters ($Nm^3$) per cubic meter ($m^3$) of liquid charge.

The catalyst in stage b) is preferably a hydroconversion catalyst consisting of an amorphous support and at least one metal or metal compound having a hydrogenating function.

Generally, a catalyst is used whose pore distribution is suitable for the treatment of charges containing metals.

The hydrogenating function can be provided by at least one group VIII metal, for example nickel and/or cobalt most often in combination with at least one group VIB metal, for example molybdenum and/or tungsten. It is possible, for example, to use a catalyst having a nickel content from 0.5 to 10 wt. %, preferably from 1 to 5 wt. % (expressed as nickel oxide NiO) and a molybdenum content from 1 to 30 wt. %, preferably from 5 to 20 wt. % (expressed as molybdenum oxide $MoO_3$). The total content of oxides of metals of groups VI and VIII can range from about 5 to about 40 wt. %, preferably from about 7 to 30 wt. %. In the case of a catalyst comprising group VI and group VIII metals, the weight ratio expressed as metal oxide of metal (or metals) of group VI to metal (or metals) of group VIII can range from about 1 to about 20, preferably from about 2 to about 10.

The support of the catalyst of stage b) can be selected from the group comprising alumina, silica, silica-aluminas, magnesia, clays and mixtures of at least two of these minerals. The said support can also contain other compounds, for example oxides selected from the group comprising boron oxide, zirconia, titanium oxide, and phosphoric anhydride. Preferably, the support is based on alumina. The alumina used is usually a beta or gamma alumina. The support, especially in the case of alumina, can be doped with phosphorus and possibly with boron and/or silicon. In this case, the concentration of phosphoric anhydride $P_2O_5$ is generally less than about 20 wt. %, preferably less than about 10 wt. % and at least 0.001 wt. %. The concentration of boron trioxide $B_2O_3$ is generally between 0 and about 10 wt. %. This catalyst is most often in the form of extrudate.

Preferably, the catalyst of stage b) is based on nickel and molybdenum, doped with phosphorus and supported on alumina.

The spent catalyst is generally replaced, partly, by fresh catalyst using take-off means at the bottom of the reactor and means of supplying fresh or new catalyst at the top of the reactor. Catalyst removal and supply can be effected at regular time intervals, i.e. for example in bursts, or quasi-continuously or continuously. For example, it is possible to introduce fresh catalyst every day. The rate of replacement of the spent catalyst with fresh catalyst can range from about 0.05 kg to about 10 kg per cubic meter of charges. Catalyst removal and supply are effected by means of devices permitting continuous operation of the hydroconversion stage b). The device in which stage b) is carried out generally includes a return pump that enables the catalyst to be maintained in suspension in the bubbling bed, with at least a proportion of a liquid removed at the top of the reactor being reinjected continuously at the bottom of the reactor. It is also possible for the used catalyst removed from the reactor to be sent to a regeneration zone, in which the carbon and sulphur that it contains are removed, and for this regenerated catalyst to then be sent to the hydroconversion stage b).

In stage c) of the process of the invention, the effluent from stage b) is fractionated to recover gasolines, kerosene, gas oil and a first residue. This residue contains compounds having boiling points above those of the gas oil.

The fractionation in stage c) can be carried out by any means known to a person skilled in the art, for example by distillation. It is possible to carry out an atmospheric distillation followed by a vacuum distillation of the residue recovered during the atmospheric distillation. Accordingly, the first residue can be an atmospheric residue or a vacuum residue.

Preferably, following stage c), a separation of the solid particles of catalyst is carried out. These catalyst particles are most often fines produced by mechanical degradation of the catalyst used in the hydroconversion stage b). Generally a rotary filter is used, a basket filter, or a centrifugation system such as a hydrocyclone combined with filters or an in-line settler. This supplementary stage makes it possible to prevent the rapid deactivation of the catalyst used in stage d) owing to the possible presence of molybdenum in the catalyst fines. According to a particular embodiment of this filtration stage, at least two means of separation are used in parallel, one being used for carrying out the separation while the other is purged of the retained catalyst fines.

In the case where stage c) includes a vacuum distillation, the vacuum distillate can be sent to a catalytic hydrocracking stage.

The hydrocracking stage is generally carried out on at least one fraction of the vacuum distillate in the presence of hydrogen, in order to obtain an effluent containing gasoline, kerosene, gas oil and a residue.

In this hydrocracking stage, at least some of the first residue obtained in stage c) plus possibly a vacuum distillate from direct distillation are hydrocracked catalytically in conditions that are well known to a person skilled in the art, in order to produce a fuel fraction (comprising a gasoline fraction, a kerosene fraction and a gas oil fraction) which is usually sent at least in part to the fuel pools and a residue fraction.

Within the scope of the present invention, the expression catalytic hydrocracking encompasses the cracking methods comprising at least a stage of conversion of the vacuum distillate fraction using at least one catalyst in the presence of hydrogen.

The operating conditions employed in the hydrocracking stage make it possible to achieve conversion rates per pass, of products having boiling points below 340° C., and preferably below 370° C., greater than 10 wt. % and even more preferably greater than 15 wt. %, or even greater than 40 wt. %.

Consequently, the expression catalytic hydrocracking can encompass mild hydrocracking, the aim of which is a hydrorefining converting of the charge of an FCC and conventional hydrocracking.

As for conventional hydrocracking, it encompasses single-stage schemes comprising firstly, and generally, hard hydrorefining whose aim is to effect hard hydrodenitration and desulphurization of the charge before all of the effluent is sent on to the actual hydrocracking catalyst, especially in the case where the latter includes a zeolite. It also encompasses two-stage hydrocracking that comprises a first stage whose aim, as in the "single stage" method, is to carry out the hydrorefining of the charges, but also to achieve a conversion of the latter generally of the order of 40 to 60%. In the second stage of a two-stage hydrocracking process, only the fraction of the charges not converted during the first stage is treated.

The catalysts for conventional hydrorefining generally contain at least one amorphous support and at least one hydro-dehydrogenating element (generally at least one non-noble element of groups VIB and VIII, and most often at least one element of group VIB and at least one non-noble element of group VIII).

The matrices that can be used in the hydrorefining catalyst alone or mixed are, for example, alumina, halogenated alumina, silica, silica-alumina, clays (selected for example from natural clays such as kaolin or bentonite), magnesia, titanium oxide, boron oxide, zirconia, aluminium phosphates, titanium phosphates, zirconium phosphates, charcoal, aluminates. It is preferred to use matrices containing alumina, in all the forms known to a person skilled in the art, and even more preferably aluminas, for example gamma alumina.

The catalysts described above are generally employed to carry out the cracking of the vacuum distillate fraction in a mild hydrocracking process, hydrorefining and in the hydrorefining stage of conventional hydrocracking.

To achieve this cracking, the charges is generally brought into contact, in the presence of hydrogen, with at least one catalyst as described previously, at a temperature between 330 and 450° C., preferably between 360 and 425° C., at a pressure between 4 and 25 MPa, preferably below 20 MPa, at a space velocity between 0.1 and 6 $h^{-1}$, preferably between 0.2 and 3 $h^{-1}$, and with a quantity of introduced hydrogen such that the volume ratio in liters of hydrogen per liter of hydrocarbon is between 100 and 2000 l/l.

In the case of a conventional hydrocracking, the vacuum distillate fraction undergoes, in the hydrorefining zone, a hard hydrotreatment on a catalyst such as that described previously, so that it is hydrodesulphurized and hydrodenitrated before being introduced, fully or partly, into a second reaction zone containing a hydrocracking catalyst.

The operating conditions employed in the reactor or reactors of this second reaction zone are generally a temperature above 200° C., often between 250 and 480° C., advantageously between 320 and 450° C., preferably between 330 and 420° C., a pressure between 5 and 25 MPa, preferably below 20 MPa, a space velocity between 0.1 and 20 $h^{-1}$ and preferably between 0.1 and 6 preferably between 0.2 and 3 $h^{-1}$, and a quantity of introduced hydrogen such that the volume ratio in liters of hydrogen per liter of hydrocarbon is between 80 and 5000 l/l, most often between 100 and 2000 l/l.

This reaction zone generally comprises at least one reactor containing at least one hydrocracking catalyst fixed bed. This hydrocracking catalyst fixed bed can be preceded by at least one fixed bed of a hydrorefining catalyst as described previously. The hydrocracking catalysts used in the hydrocracking, processes are generally of the bifunctional type combining an acid function and a hydrogenating function. The acid function can be performed by supports having a large surface area (generally 150 to 800 $m^2/g^{-1}$) and exhibiting a surface acidity, such as halogenated aluminas (in particular chlorinated or fluorinated), combinations of oxides of boron and aluminium, amorphous silica-aluminas called amorphous hydrocracking catalysts and zeolites. The hydrogenating function can be performed either by one or more metals of group VIII of the periodic table of the elements, or by a combination of at least one metal of group VIB of the periodic table and at least one metal of group VIII.

The hydrocracking catalyst can contain at least one crystalline acid function such as a Y zeolite, or an amorphous acid function such as a silica-alumina, at least one matrix and a hydro-dehydrogenating function. If necessary, it can also contain at least one element selected from boron, phosphorus and silicon, at least one group VIIA element (chlorine, fluorine for example), at least one group VIIB element (manganese for example), and at least one group VB element (niobium for example).

In stage d) of the method of the invention, a catalytic cracking of at least some of the first residue is carried out, to obtain an effluent comprising gasolines, kerosene; gas oils and a second residue.

The specific deasphalting conditions of stage a) of the method of the invention are such that the first residue arising from the effluent from hydroconversion stage b) has a level of purity sufficient to permit a high-performance cracking in stage d). In particular, stage a) according to the invention makes it possible to obtain an effluent leaving stage b) having, preferably, a Conradson carbon residue content below 10 wt. %, more preferably below 5 wt. % and a nitrogen content below 3000 ppm, which is favourable for obtaining a high rate of conversion of the residue from stage b) combined with obtaining high yields of gasolines, kerosene and gas oil. Thus, the conditions severity of deasphalting stage a) combined with the conditions of hydroconversion stage b) and of cracking stage d) contribute to an increase in the yield of gasolines, kerosene and gas oils of the method of the invention and to improvement of the quality of these products. Note, in addition, that in the case where stage d) includes a hydrocracking, the products obtained from the catalytic cracking and from the catalytic hydrocracking are of adequate quality for use directly or with few post-treatments.

At least some of the first residue obtained in stage c) is cracked catalytically in conditions that are well-known to a person skilled in the art to produce, on the one hand, a fuel fraction (comprising a gasoline fraction and a gas oil fraction) which is usually sent at least in part to the fuel pools and, on the other hand, a slurry fraction that can be sent, at least partly, even completely, to the heavy fuel pool or recycled at least partly, or even completely, to catalytic cracking stage d). Within the scope of the present invention, the expression conventional catalytic cracking encompasses cracking processes comprising at least one stage of regeneration by partial combustion and those comprising at least one stage of regeneration by total combustion and/or those comprising, simultaneously, at least one stage of partial combustion and at least one stage of total combustion.

This catalytic cracking can be as described in Ullmans Encyclopedia of Industrial Chemistry Volume A 18, 1991, pages 61 to 64. Usually a conventional catalyst is used comprising a matrix, an additive if required and at least one zeolite. The quantity of zeolite is variable but usually about 3 to 60 wt. %, often about 6 to 50 wt. % and most often about 10 to 45 wt. %. The zeolite is usually dispersed in the matrix. The quantity of additive is usually about 0 to 30 wt. % and often about 0 to 20 wt. %. The quantity of matrix represents the complement to 100 wt. %. The additive is generally selected from the group comprising the oxides of metals of group IIA of the periodic table of the elements such as, for example, magnesium oxide or calcium oxide, the oxides of rare earths and the titanates of group IIA metals. Most often the matrix is a silica, an alumina, a silica-alumina, a silica-magnesia, a clay or a mixture of two or more of these products. The zeolite most commonly used is Y zeolite.

The cracking is carried out in a more or less vertical reactor either in ascending mode (riser) or in descending mode (dropper). The choice of catalyst and of operating conditions depends on the sought products in relation to the charge treated as described for example in the article by C. Marcilly pages 990-991 published in the journal of the Institut Français du Pétrole November-December 1975 pages 969-1006. Operation is usually at a temperature from about 450 to about 600° C. and with residence times in the reactor of less than 1 minute, often from about 0.1 to about 50 seconds.

The catalytic cracking can also be a fluidized-bed catalytic cracking, for example according to the method developed by the applicant called R2R. This fluidized-bed catalytic cracking can be carried out in the conventional manner known to a person skilled in the art in appropriate cracking conditions in order to produce hydrocarbon products of lower molecular weight. The reactor for fluidized-bed catalytic cracking can operate with ascending flow or descending flow. Although it is not a preferred embodiment of the present invention, it is also conceivable to the carry out catalytic cracking in a moving-bed reactor. The particularly preferred catalytic cracking catalysts are those that contain at least one zeolite usually mixed with an appropriate matrix, for example alumina, silica, or silica-alumina.

The effluent obtained in stage d) is generally fractionated to recover at least a gasoline fraction, a kerosene fraction, gas oil and a second residue. This fractionation can be carried out by any means known to a person skilled in the art, for example by distillation. Generally, an atmospheric distillation is employed, followed by a vacuum distillation of the residue recovered during the atmospheric distillation.

Figure 2:
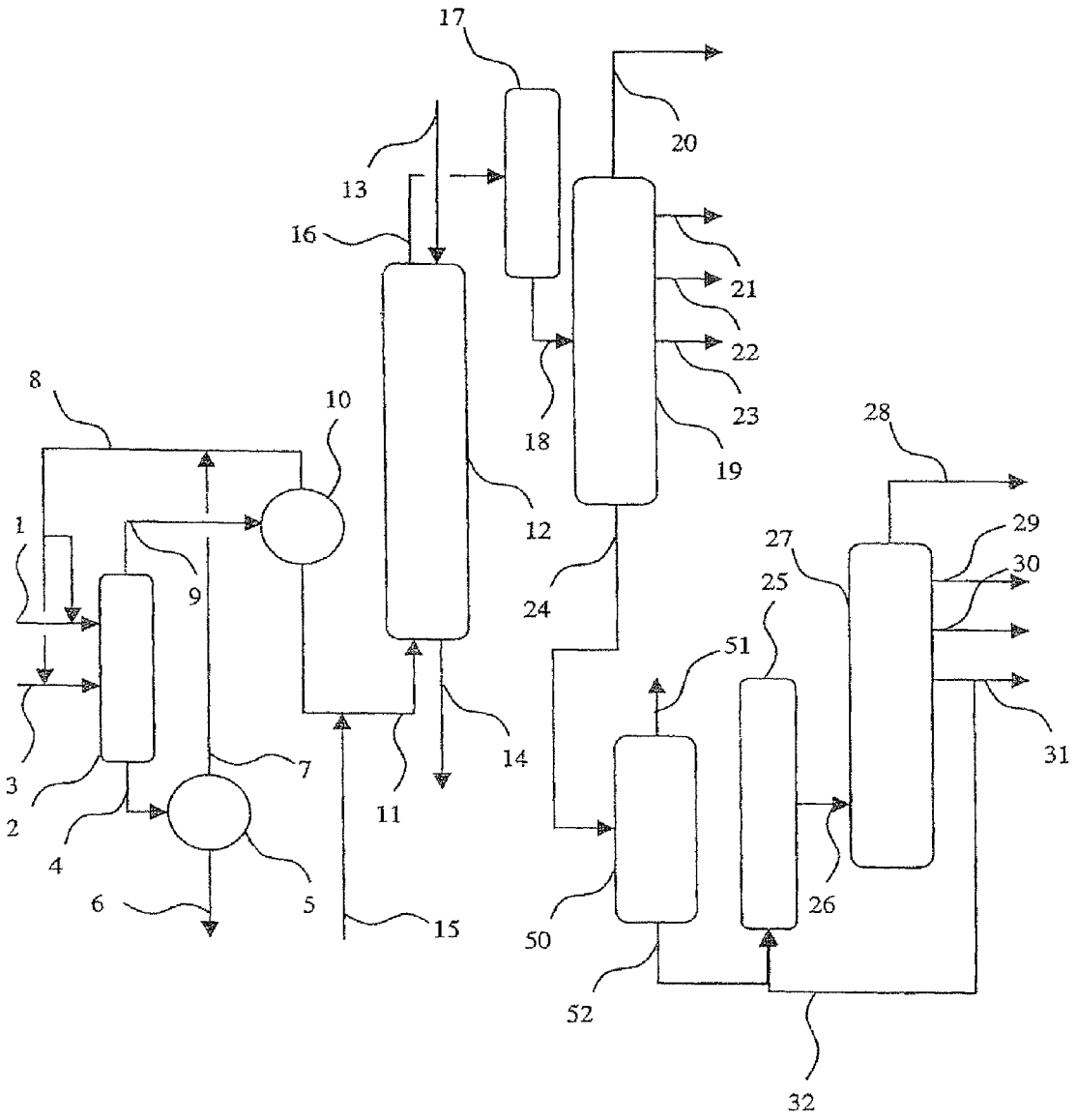
FIG. 2 shows, as an example, a flow diagram similar to that of FIG. 1, but in which the fractionation stage comprises an atmospheric distillation and a vacuum distillation, the vacuum distillate being sent to a hydrocracking stage.

FIGS. 1 and 2 show schematic representations of the main variants for the implementation of the method according to the present invention.

In FIG. 1, the hydrocarbon charge to be treated passes via line 1 into the deasphalting section 2 in the presence of a solvent, the said solvent being introduced via line 3. The asphalt fraction plus some of the solvent injected into section 2 is removed via line 4 and directed to a section 5 for separation of the solvent and asphalt. The asphalt is removed via line 6. The solvent is removed via line 7 and reinjected into section 2 via lines 8, 1 and 3. The deasphalted fraction, commonly called deasphalted oil, plus a proportion of the solvent injected into section 2 is removed via line 9 and directed to a section 10 for separating the solvent and the deasphalted oil. The solvent is removed via line 8 and reinjected into section 2 via lines 8, 1 and 3. The deasphalted oil to be hydrocracked passes via line 11 into the bubbling-bed hydroconversion section 12. Catalyst is fed in via line 13 and removed via line 14. Hydrogen is introduced via line 15. The effluent treated in section 12 is sent via line 16 into a separation section 17, from which an effluent is recovered after expansion, via line 18, and is sent to distillation section 19, from which a gas fraction is recovered via line 20, a gasoline fraction via line 21, a kerosene fraction via line 22 and a gas oil fraction via line 23. The atmospheric residue is sent via line 24 into section 25 for catalytic cracking. The effluent from the catalytic cracking section is sent via line 26 to a distillation section 27, from which a gaseous fraction is recovered via line 28, a gasoline fraction via line 29, a gas oil fraction via line 30 and a slurry fraction via line 31, one part of the latter being sent to the heavy fuel pool of the refinery, another part of this slurry fraction possibly being sent via line 32 to the catalytic cracking section 25, and another part possibly being sent to section 12 for bubbling-bed treatment. Part of the gas oil fraction from line 23 is possibly sent with the residue from line 24 into the catalytic cracking section 25. Part of the gasoline fraction from line 21 or 22 is possibly sent with the residue from line 24 into the catalytic cracking section 25.

In the particular embodiment of the invention shown schematically in FIG. 2, the atmospheric residue obtained in section 19 is sent via line 24 to a vacuum distillation section 50 where a vacuum distillate fraction is recovered via line 51 and a vacuum residue fraction via line 52. The vacuum distillate fraction is sent to a catalytic hydrocracking zone. The vacuum residue fraction is sent via line 52 to a catalytic cracking zone 25 according to the process described in FIG. 1.

The following example, from experiments carried out in pilot plants, allow the present invention to be illustrated.

EXAMPLE

A vacuum residue (VR) of heavy crude is deasphalted with pentane. The vacuum residue has the following properties:

| Properties of the Vacuum Residue | |
|---|---|
| D15/4 | 1.06 |
| Sulphur, wt. % | 5.7 |
| Ni + V, ppm by weight | 500 |
| Nitrogen, ppm by weight | 6800 |
| insoluble C7 asphaltenes, wt. % | 17 |
| Conradson carbon residue, wt. % | 25 |

The operating conditions of the deasphalting stage are as follows:

| | |
|---|---|
| Overall dilution ratio, v/v | 5/1 |
| Ratio of solvent injected with the charges, v/v | 1/1 |
| Ratio of solvent at extractor bottom, v/v | 4/1 |
| Temperature at the top of the extractor, ° C. | 188 |
| Temperature at extractor bottom, ° C. | 158 |
| Extractor pressure, MPa | 4.2 |

A deasphalted oil is produced with a yield of 62 wt. % and an asphalt is produced with a yield of 38 wt. %. All yields are calculated from a base of 100 (by weight) of vacuum residue.

The deasphalted oil has the following properties:

| Deasphalted oil | |
|---|---|
| Specific density | 1.01 |
| Content of nickel + vanadium, ppm by weight | 130 |
| Sulphur content, wt. % | 4.6 |
| Nitrogen content, wt. % | 0.42 |
| Conradson carbon residue, wt. % | 12.0 |
| Content of asphaltenes (insoluble in heptane) NF-T 60-115, wt. % | <0.05 |

The deasphalted oil is mainly characterized by its content of asphaltenes (insoluble in heptane) according to standard NF-T 60-115 which is below 0.05 wt. % which makes it a clean deasphalted oil of very high quality.

This deasphalted oil is then introduced, in the presence of hydrogen, into a pilot bubbling-bed reactor to obtain a conversion of 85 wt. % of the 524° C.+ fraction.

This reactor contains 1 liter of a catalyst that is specific for the application T-STAR® manufactured by AXENS under the reference HTS-458 which is specific to the bubbling-bed treatment of heavy charges containing metals.

The operating conditions employed are as follows:

HSV relative to the packed catalyst bed: 0.8 $h^{-1}$

Hydrogen pressure: 13.5 MPa

Hydrogen recycling: 600 liters of hydrogen per liter of charges

Temperature in the reactor: 435° C.

Catalyst age: 29 days

The overall performance values of the catalyst are as follows:

| | |
|---|---|
| Degree of desulphurization HDS, % | 96.7 |
| Degree of denitration HDN, % | 71 |
| Degree of reduction of Conradson carbon residue HDCCR, % | 90 |
| Degree of demetalization HDM, % | 99.9 |

The degree of purification of an impurity X is defined as follows:

$$\frac{100*(X\ \text{charge} - X\ \text{product})}{X\ \text{charge}}$$

where Xchange represents the level of impurities in the charge and Xproduct represents the level of impurities in the liquid product The yield structure obtained after TBP laboratory distillation of the liquid effluent by atmospheric flash at the outlet of the bubbling-bed reactor is as follows:

| Cut | Yield by weight compared with the deasphalted oil |
|---|---|
| Gasoline 1 | 16 |
| Kerosene 1 | 13 |
| Gas oil 1 | 18 |
| Atmospheric residue 1 | 42 |

At this stage, the yields of gasoline, kerosene and gas oil compared with the undeasphalted vacuum residue are as follows:

| Cut | Yield by weight compared with the undeasphalted vacuum residue |
|---|---|
| Gasoline 1 | 16 * 0.62 = 9.9 |
| Kerosene 1 | 13 * 0.62 = 8.1 |
| Gas oil 1 | 18 * 0.62 = 11.2 |
| Residue 1 | 42 * 0.62 = 26.0 |

The characteristics of the combined products are as follows:

| | |
|---|---|
| Gasoline 1 | |
| Sulphur/nitrogen, ppm by weight | <50/10 |
| Density | 0.737 |
| Kerosene 1 | |
| Sulphur/nitrogen, ppm by weight | 210/175 |
| Density | 0.824 |
| Gas oil 1 | |
| Sulphur/nitrogen, ppm by weight | 280/500 |
| Density | 0.866 |
| Cetane number, ASTM D613 | 46 |
| Atmospheric residue 1 | |
| Sulphur/nitrogen, ppm by weight | 2950/2320 |
| Density | 0.932 |
| Hydrogen NMR, wt. % | 11.8 |
| Ni + V, ppm by weight | <1 |
| CCR, wt. % | 2.5 |

The distillates produced at the end of this stage, in particular the gas oil, possess characteristics that allow consideration of a moderate hydrotreatment in order to meet the current specifications.

Atmospheric residue 1, called first residue in the present invention, is treated in a conventional catalytic cracking unit. The residue thus prepared surprisingly possesses, exceptional purity and hydrogenation properties. In particular this residue is characterized by a low Conradson carbon residue which allows the formation of coke to be limited.

Conversion of this residue in an FCC unit at a rate of 74 wt. % of the 360° C.+ fraction in a maximum-gasoline operation gives the following yields:

| | |
|---|---|
| Gas and LPG | |
| wt. % of atmospheric residue | 18.6 |
| Gasoline 2 | |
| wt. % of atmospheric residue | 47.6 |
| Sulphur content, ppm by weight | 90 |
| Gas oil 2 (LCO) | |
| wt. % of atmospheric residue | 14.8 |
| Sulphur content, wt. % | 0.390 |
| Slurry (second residue according to the invention) | |
| wt. % of atmospheric residue | 11.6 |
| Coke | |
| wt. % of atmospheric residue | 7.4 |

Finally, at the end of the stages of deasphalting, bubbling-bed hydroconversion and catalytic cracking, the overall yields of gasoline, kerosene and gas oil compared with the undeasphalted vacuum residue are as follows:

| Cut | Yield by weight relative to the undeasphalted vacuum residue |
|---|---|
| Gasoline 1 + Gasoline 2 | 9.9 + 12.4 = 22.3 |
| Kerosene 1 | 8.1 |
| Gas oil 1 + Gas oil 2 | 11.2 + 3.8 = 15.0 |
| Residue 2 | 3.0 |
| Asphalt | 38 |

The distillates produced are moreover characterized by low impurities contents (for example sulphur in the gas oil) which will require moderate additional hydrotreatments in order to meet the current specifications. These distillates can therefore be commercially valorized individually.

Without further elaboration, it is believed that one skilled in the art can, using the preceding description, utilize the present invention to its fullest extent. The preceding preferred specific embodiments are, therefore, to be construed as merely illustrative, and not imitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications (including but not limited to standard NF-T-60-115), cited herein and of corresponding French application No. 03/05.211, filed Apr. 25, 2003 are incorporated by reference herein.

The preceding examples can be repeated with similar success by substituting the generically or specifically described reactants and/or operating, conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A method of treatment of a hydrocarbon charge containing at least 95 wt. % of compounds having a boiling point of at least 340° C., said method comprising the following stages:

a) contacting the charge with a solvent in order to obtain a deasphalted effluent having a content of asphaltenes (insoluble in n-heptane according to standard NF-T-60-115) below 3000 ppm by weight, and containing components boiling above 500° C., b) subjecting the entirety of the deasphalted effluent from stage a) to cracking in the presence of hydrogen and a hydrocracking catalyst, in a bubbling-bed reactor, so as to convert at least 50 wt. % of the fraction of the deasphalted effluent boiling above 500° C. to compounds having a boiling point below 500° C., c) fractionating the effluent from stage b) to recover gasolines, kerosene, gas oils and a first residue, and d) cracking at least a portion of said first residue catalytically so as to obtain an effluent comprising gasolines, kerosene, gas oils and a second residue.

2. A method according to claim 1, wherein the hydrocarbon charge has a final boiling point above 600° C.

3. A method according to claim 1, wherein the hydrocarbon charge consists essentially of atmospheric residues and vacuum residues from heavy crudes.

4. A method according to claim 1, wherein the content of asphaltenes in the deasphalted effluent is below 1000 ppm by weight.

5. A method according to claim 1, wherein the content of asphaltenes in the deasphalted effluent is below 500 ppm by weight.

6. A method according to claim 1, wherein said solvent in stage a) contains at least 50 wt. % of hydrocarbon compounds having between 3 and 7 carbon atoms.

7. A method according to claim 1, wherein the deasphalting stage (a) is carried out in an extraction column.

8. A method according to claim 1, wherein the hydrocracking catalyst of stage b) is a hydroconversion catalyst comprising an amorphous support and at least one metal or metal compound having a hydrogenating function.

9. A method according to claim 1, further comprising following stage c), separating solid catalyst particles.

10. A method according to claim 1, wherein stage c) comprises an atmospheric distillation followed by a vacuum distillation.

11. A method according to claim 10, wherein the vacuum distillate is sent to a hydrocracking stage.

* * * * *